US008171896B2

(12) United States Patent
Hanai et al.

(10) Patent No.: US 8,171,896 B2
(45) Date of Patent: May 8, 2012

(54) COOLING STRUCTURE OF INTERNAL COMBUSTION ENGINE

(75) Inventors: Shuichi Hanai, Nissin (JP); Takashi Kubota, Obu (JP); Makoto Hatano, Nagoya (JP); Yoshifumi Fujita, Tokyo (JP)

(73) Assignees: Toyota Jidosha Kabushiki Kaisha, Toyota-shi, Aichi-ken (JP); Aisan Kogyo Kabushiki Kaisha, Obu-shi, Aichi-ken (JP); Nichias Corporation, Minato-Ku, Tokyo-to (JP)

( * ) Notice: Subject to any disclaimer, the term of this patent is extended or adjusted under 35 U.S.C. 154(b) by 478 days.

(21) Appl. No.: 12/430,423

(22) Filed: Apr. 27, 2009

(65) Prior Publication Data

US 2009/0266315 A1 Oct. 29, 2009

(30) Foreign Application Priority Data

Apr. 25, 2008 (JP) ..... 2008-115933

(51) Int. Cl.
*F02B 75/18* (2006.01)

(52) U.S. Cl. ..... 123/41.28; 123/41.29; 123/41.31; 123/41.72; 123/41.82 R

(58) Field of Classification Search ..... 123/41.82 R, 123/41.81, 41.8, 41.79, 41.72, 41.31, 41.29, 123/41.28

See application file for complete search history.

(56) References Cited

U.S. PATENT DOCUMENTS 5,988,120 A * 11/1999 Betsch et al. ..... 123/41.74
7,082,908 B2 8/2006 Matsutani et al.

FOREIGN PATENT DOCUMENTS

| | | | |
|---|---|---|---|
| JP | 10077837 | A | 3/1998 |
| JP | 2002161743 | A | 6/2002 |
| JP | 2005171785 | A | 6/2005 |
| JP | 2005282373 | | 10/2005 |
| JP | 2006090193 | | 4/2006 |
| JP | 2006090193 | A * | 4/2006 |
| JP | 2008008195 | | 1/2008 |

* cited by examiner

*Primary Examiner* — Noah Kamen
*Assistant Examiner* — Hung Q Nguyen
(74) *Attorney, Agent, or Firm* — Gifford, Krass, Sprinkle, Anderson & Citkowski, P.C.

(57) ABSTRACT

A cooling structure of an internal combustion engine includes: a cooling water introducing port provided on one end side of a cylinder block; and a water jacket provided so as to surround a cylinder bore wall, wherein cooling water is introduced from the cooling water introducing port into the water jacket, the cooling water is branched to flow to a portion on an intake side and a portion on an exhaust side of the water jacket of the cylinder block of the internal combustion engine, and the cooling water is supplied from a cylinder block side to a cylinder head side, the cooling structure of the internal combustion engine, further comprising a first regulation portion that regulates a flow of the cooling water supplied to the cylinder head side.

14 Claims, 9 Drawing Sheets

COOLING STRUCTURE OF INTERNAL COMBUSTION ENGINE

INCORPORATION BY REFERENCE

The disclosure of Japanese Patent Application No. 2008-115933 filed on Apr. 25, 2008 including the specification, drawings and abstract is incorporated herein by reference in its entirety.

BACKGROUND OF THE INVENTION

1. Field of the Invention

The invention relates to a structure for cooling an internal combustion engine, for example, of an automobile, with cooling water.

2. Description of the Related Art

In an internal combustion engine, water jackets for causing a flow of a coolant (cooling water) therethrough are provided at a cylinder block side and a cylinder head side. A water jacket of the cylinder block (referred to hereinbelow simply as "water jacket") is provided so as to surround a cylinder bore wall. In the water jacket, cooling water pumped by a water pump is introduced from a cooling water introducing port formed in a wall portion of the cylinder block. The cooling water introducing port is formed, for example, on one end side in the cylinder bore row direction of the cylinder block. The flow of cooling water introduced from the cooling water introducing port cools the cylinder bore wall heated by heat from the combustion chambers.

The water jacket of the cylinder head is provided mainly on the periphery of combustion chambers or on the periphery of exhaust ports. The water jacket of the cylinder head communicates with the water jacket of the cylinder block, and the cooling water from the water jacket of the cylinder block flows into the water jacket of the cylinder head. In this case, the cooling water from the cylinder block side flows to the cylinder head side via gasket holes (openings) formed in a cylinder head gasket introduced between the cylinder block and cylinder head.

In the related art, for example, Japanese Patent Application Publication No. 2006-90193 (JP-A-2006-90193) discloses a cooling structure of an internal combustion engine in which cooling water introduced from a cooling water introducing port formed in one end side of a cylinder block branches to an intake side (intake side of the internal combustion engine) and exhaust side (exhaust side of the internal combustion engine) of the water jacket and cools the cylinder bore wall. JP-A-2006-90193 indicates that a spacer that partitions the water jacket into an inner passage and an outer passage is provided in the water jacket to inhibit an overcooling phenomenon in a portion in the vicinity of the cooling water introducing port in the cylinder bore wall. Furthermore, it is indicated that a regulation portion (closing portion) that regulates the flow of cooling water from the cooling water introducing port to the inner passage from an upper or lower end portion of the spacer is provided in a portion of the spacer that faces the cooling water introducing port.

However, in the above-described cooling structure of an internal combustion engine, the flow rate of cooling water supplied to the exhaust side has to be made larger than the flow rate of cooling water supplied to the intake side of the water jacket in order to obtain a uniform temperature distribution in the portion of the cylinder bore wall on the intake side and the portion thereof on the exhaust side. In the cooling structure described in JP-A-2006-90193, the flow rate of cooling water supplied to the intake side and the flow rate of cooling water supplied to the exhaust side may be adjusted by adjusting gaps (flow channel surface areas) on the left side and right side of the regulation portion provided at the spacer. The flow rate of cooling water to the exhaust side may be increased over that to the intake side by setting a gap (flow channel surface area) that introduces the cooling water to the exhaust side larger than the gap (flow channel surface area) that introduces the cooling water to the intake side.

However, in the cooling structure described in JP-A-2006-90193, the flow rate of cooling water supplied to the exhaust side decreases because of a structure in which the cooling water supplied to the water jacket of the cylinder head is divided between the cooling water introducing port and regulation portion. This will be described in greater detail below by using a schematic view in FIG. 9.

As shown in FIG. 9, the cooling water introduced from the cooling water introducing port a branches to cooling water supplied to the water jacket of the cylinder block and cooling water supplied to the water jacket of the cylinder head via a gasket head d. Where the cooling water flow rate from the cooling water introducing port a is denoted by Qa and the cooling water flow rate to the water jacket of the cylinder head is denoted by Qd, the flow rate of cooling water supplied to the water jacket of the cylinder block will be [Qa−Qd]. The cooling water flow rate Qd to the water jacket of the cylinder head is adjusted by setting an opening surface area Sd of the gasket head d.

Then, the cooling water supplied to the water jacket of the cylinder block branches to cooling water supplied to a portion b of the cylinder block on the exhaust side and cooling water supplied to a portion c on the intake side correspondingly to flow channel surface areas Sb and Sc that guide the cooling water to the exhaust side and intake side on both sides of the above-described regulation portion. Therefore, the cooling water flow rate Qb to the portion b on the exhaust side is set to a flow rate obtained by subtracting the cooling water flow rate Qd to the water jacket of the cylinder head and the cooling water flow rate Qc to the portion c on the intake side from the cooling water flow rate Qa from the cooling water introducing port a. In other words, the relationship [Qb=(Qa−Qd)−Qc] is satisfied.

Here, a predetermined flow rate has to be reserved for the cooling water flow rate Qd to the water jacket of the cylinder head. Therefore, in a case where a large cooling water flow rate Qd has to be ensured, a state may occur in which the cooling water flow rate Qb to the portion b on the exhaust side is insufficient. As a result, there is a concern that cooling of the portion of the cylinder bore wall on the exhaust side (in particular, the upper portion in the vicinity of the combustion chamber) will be insufficient.

Meanwhile, in order to increase the cooling water flow rate Qb to the portion b on the exhaust side, the cooling water flow rate Qa from the cooling water introducing port a may be increased or the cooling water flow rate Qc to the portion c on the intake side may be reduced. However, in the cooling structure described in JP-A-2006-90193, even if the cooling water flow rate Qa from the cooling water introducing port a is increased, the degree of contribution to the increase of the cooling water flow rate Qb to the portion b on the exhaust side is decreased because the cooling water flow rate Qd to the water jacket of the cylinder head also increases. Furthermore, even if the cooling water flow rate Qc to the portion c on the intake side is reduced, the degree of contribution to the increase of the cooling water flow rate Qb to the portion b on the exhaust side is decreased because the cooling water flow rate Qd to the water jacket of the cylinder head increases. In other words, the increase of the cooling water flow rate Qa from the cooling water introducing port a or the decrease in the cooling water flow rate Qc to the portion c on the intake side do not directly contribute to the increase in the cooling water flow rate Qb to the portion b on the exhaust side and, therefore, a state may occur in which the cooling water flow rate Qb to the portion b on the exhaust side is insufficient.

SUMMARY OF THE INVENTION

The invention provides a cooling structure of an internal combustion engine that may ensure a desirably large cooling water flow rate supplied to the water jacket of the cylinder block on the exhaust side of the internal combustion engine.

A cooling structure of an internal combustion engine of one aspect of the invention includes: a cooling water introducing port provided on one end side of a cylinder block, and a water jacket provided so as to surround a cylinder bore wall, wherein cooling water is introduced from the cooling water introducing port into the water jacket, the cooling water is branched to flow to a portion on an intake side and a portion on an exhaust side of the water jacket of the cylinder block of the internal combustion engine, and the cooling water is supplied from a cylinder block side to a cylinder head side. This cooling structure of the internal combustion engine further includes a first regulation portion that regulates a flow of the cooling water supplied to the cylinder head side. It is preferred that the regulation portion be provided in the vicinity of the cooling water introducing port and be provided integrally with a spacer that partitions the inside of the water jacket of the cylinder block. Examples of configurations that regulate the flow of cooling water include a configuration that dams up the flow of cooling water and a configuration that throttles a flow channel of cooling water.

With the cooling structure of an internal combustion engine according to the above-described aspect, the flow of cooling water supplied to the cylinder head side is regulated by the first regulation portion. Therefore, it is possible to ensure a large cooling water flow rate to the portion of the water jacket of the cylinder block on the exhaust side of the internal combustion engine may be ensured. As a result, a state in which the cooling water flow rate to the portion of the water jacket of the cylinder block on the exhaust side of the internal combustion engine is insufficient may be avoided and cooling capability of the portion of the cylinder bore wall on the exhaust side (in particular, the upper portion in the vicinity of the combustion chamber) may be increased.

In accordance with the invention, because the flow of cooling water supplied to the cylinder head side is regulated by the regulation portion, it is possible to ensure a large cooling water flow rate to the portion of the water jacket of the cylinder block on the exhaust side of the internal combustion engine. As a result, a state in which the cooling water flow rate to the water jacket of the cylinder block on the exhaust side of the internal combustion engine is insufficient may be avoided and cooling capability of the portion of the cylinder bore wall on the exhaust side may be increased.

BRIEF DESCRIPTION OF THE DRAWINGS

The foregoing and/or further objects, features and advantages of the invention will become more apparent from the following description of example embodiments with reference to the accompanying drawings, in which like numerals are used to represent like elements and wherein.

DETAILED DESCRIPTION OF EMBODIMENTS

Embodiments of the invention will be described below with reference to the appended drawings.

In the below-described embodiment an example will be explained in which the cooling structure of an internal combustion engine in accordance with the invention is applied to a linear four-cylinder internal combustion engine, but the invention may be applied to an internal combustion engine of any system and any number of cylinders.

Figure 1:
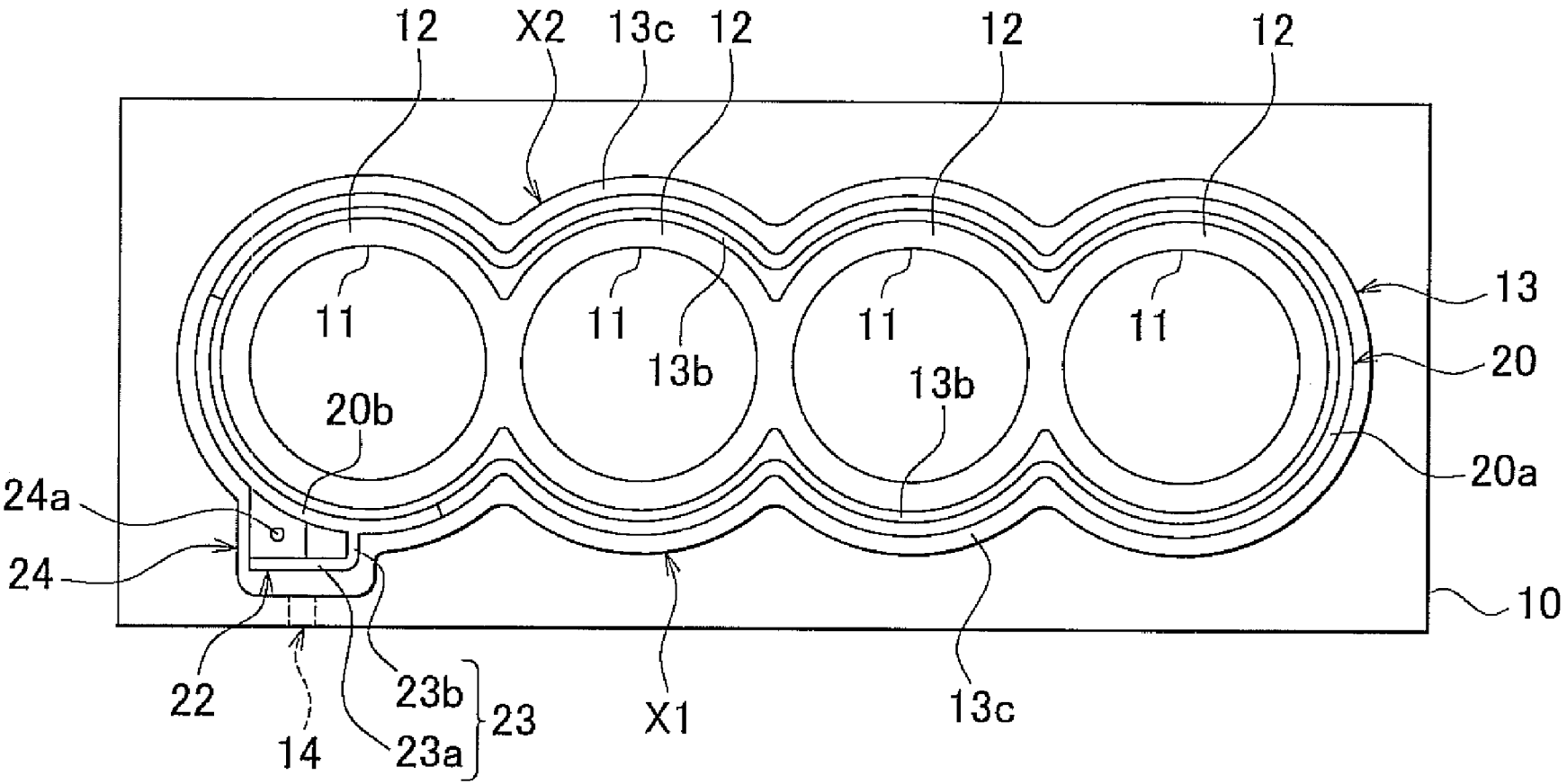
FIG. 1 is a plan view illustrating a schematic configuration of a cylinder block in an internal combustion engine of the first embodiment of the invention.
Figure 2:
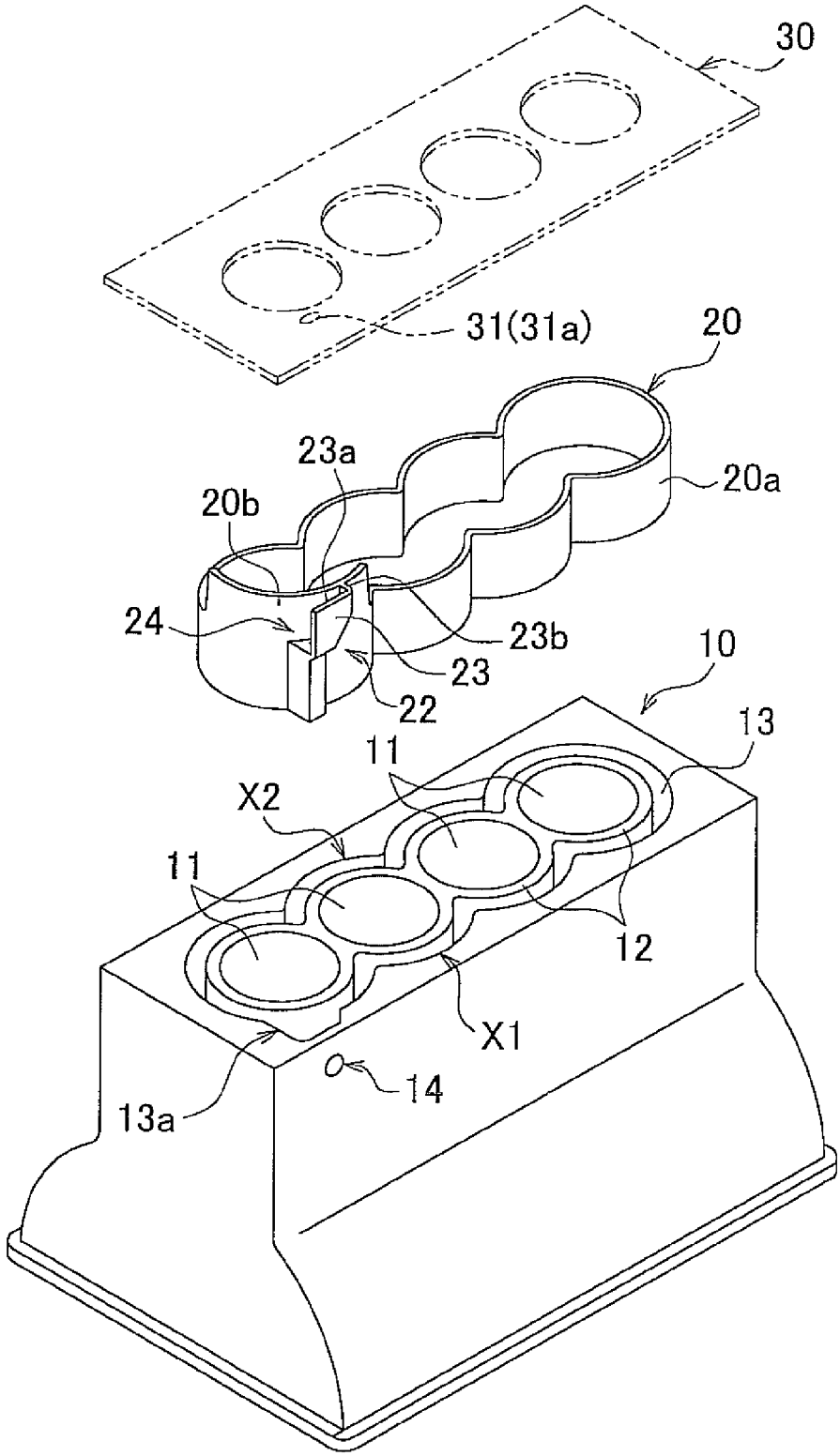
FIG. 2 is a perspective view illustrating the disassembled state of the cylinder block and spacer shown in FIG. 1.

FIG. 1 is a plan view (a view from a direction perpendicular to a top surface of a water jacket 13) illustrating a schematic configuration of a cylinder block 10 in an internal combustion engine (engine) of the first embodiment. FIG. 2 is a perspective view illustrating the disassembled state the cylinder block 10 and a spacer 20 shown in FIG. 1. FIG. 1 shows an engine cylinder bore 11 of the cylinder block 10 and a peripheral portion thereof and illustrates a disposition state of a cylinder bore row, a water jacket (cooling water passage) 13, and the spacer 20 in the cylinder block 10 (the outer edge shape of the cylinder block 10 is not shown in the figure).

The cylinder block 10 is manufactured from an aluminum alloy, and a cylinder head (not shown in the figure) is joined by head bolts via a cylinder head gasket 30 (shown by a double-dashed line in FIG. 2) to the top surface of the cylinder block 10. The cylinder block 10 has a siamese configuration in which the outer circumferential walls of the mutually adjacent cylinder bores 11 are joined together. In the first embodiment, four cylinder bore walls 12 of the cylinder bore 11 are joined in a straight row. The inner surfaces of the cylinder bores 11 are formed by cast iron cylinder liners that are cast integrally with the cylinder block 10.

The cylinder block 10 also has an open-deck configuration. In other words, the water jacket 13 is opened at the top surface of the cylinder block 10 that is a surface of assembling the cylinder head.

The water jacket 13 is formed between an outer wall of the cylinder block 10 and a cylinder bore wall 12. The water jacket 13 is provided so as to surround the four cylinder bores 11 from the outside and extends along the outer circumferential surface of the cylinder bore wall 12. The cooling water pumped by a water pump is introduced in the water jacket 13 from a cooling water introducing port 14 formed on one end side (left end side in FIG. 1) of the cylinder block 10 in the cylinder bore row direction. In this case, the cooling water is first supplied to a cooling water introducing portion 13*a* provided in the vicinity of the cooling water introducing port 14. The cooling water introducing portion 13*a* is a portion formed by causing an outer wall of the cylinder block 10 to recede toward the cooling water introducing port 14, and the below-described regulation member 22 is disposed in the cooling water introducing portion 13*a*.

The cooling water is supplied from the cooling water introducing portion 13*a* to the outer periphery of the cylinder bore wall 12. The cylinder block 10 is thereby cooled. In this case, the cooling water flow is divided into a portion X1 of the water jacket 13 on the exhaust side of the internal combustion engine and a portion X2 of the water jacket on the intake side of the internal combustion engine (the expression "internal combustion engine" will be hereinbelow omitted, and these portions will be simply referred to as "the portion on the exhaust side" and "the portion on the intake side"). The cooling water then flows out from a cooling water outflow port (not shown in the figure) provided at the other end side (right end side in FIG. 1) of the cylinder block 10.

The spacer 20 made from a synthetic resin is accommodated in the water jacket 13. The spacer 20 is a cylindrical member provided so as to surround the cylinder bore wall 12. The spacer 20 is inserted from above into the water jacket 13 and disposed in a predetermined position inside the water jacket 13. More specifically, the spacer 20 has a configuration provided with a spacer body 20*a* in which four thin-wall cylindrical portions are connected in a row. The cylinder bore wall 12 is surrounded by the spacer body 20*a*. A height of the spacer body 20*a* is less than a depth of the water jacket 13, except a portion 20*b* in the vicinity of the cooling water introducing port 14. The lower end of the spacer body reaches the bottom surface of the water jacket 13 or the vicinity thereof, whereas the upper end of the spacer body does not reach the top surface of the water jacket 13.

The inside of the water jacket 13 is partitioned by the spacer 20. More specifically, the water jacket 13 is partitioned into an inner passage 13*b* located between the cylinder bore wall 12 and the inner circumferential surface of the spacer body 20*a*, and an outer passage 13*c* located between the outer wall of the cylinder block 10 and the outer circumferential surface of the spacer body 20*a*. The cooling water from the cooling water introducing portion 13*a* is first supplied to the outer passage 13*c* and then flows through to the inner passage 13*b*. By using such a spacer 20, it is possible to prevent a portion of the cylinder bore wall 12 in the vicinity of the cooling water introducing port 14 from being overcooled with respect to other portions of the cylinder bore wall.

The regulation member 22 is provided integrally with the spacer body 20*a*. The regulation member 22 is formed to protrude to the outside (side of the cooling water introducing port 14) of the portion 20*b* of the spacer body 20*a* in the vicinity of the cooling water introducing port 14. The regulation member 22 is provided to regulate the flow of cooling water supplied to the water jacket on the cylinder head side by a method such as damming up the cooling water. More specifically, the regulation member 22 is provided to regulate the supply of the cooling water introduced from the cooling water introducing port 14 to a portion other than the portion X1 of the water jacket 13 on the exhaust side, namely, to the portion X2 on the intake side and to the water jacket on the cylinder head side via gasket holes 31.

The height of the portion 20*b* (portion in the vicinity of the cooling water introducing port 14) of the spacer body 20*a* where the regulation member 22 is provided is almost equal to the depth of the water jacket 13, and the portion 20*b* where the regulation member 22 is provided is provided from the bottom surface to the top surface of the water jacket 13. In other words, the portion 20*b* where the regulation member 22 is provided is higher than other portions of the spacer body 20*a*. The regulation member 22 will be described below in greater detail.

Gasket holes (openings) 31 that serve to supply the cooling water from the water jacket 13 of the cylinder block 10 to the water jacket of the cylinder head are formed in a plurality of location of the cylinder gasket 30 inserted between the cylinder block 10 and the cylinder head that is assembled from the upper side of the cylinder block 10. Therefore, part of the cooling water flowing through the water jacket 13 is supplied via the gasket holes 31 to the water jacket on the cylinder head side. In other words, the flow of cooling water introduced from the cooling water introducing port 14 in the water jacket 13 is divided toward the cylinder head side. FIG. 2 shows only a gasket hole 31*a* that is the closest to the cooling water introducing port 14. This gasket hole 31*a* is provided in a position adjacent to the cooling water introducing portion 13*a* of the water jacket 13 (see FIG. 4).

Figure 3:
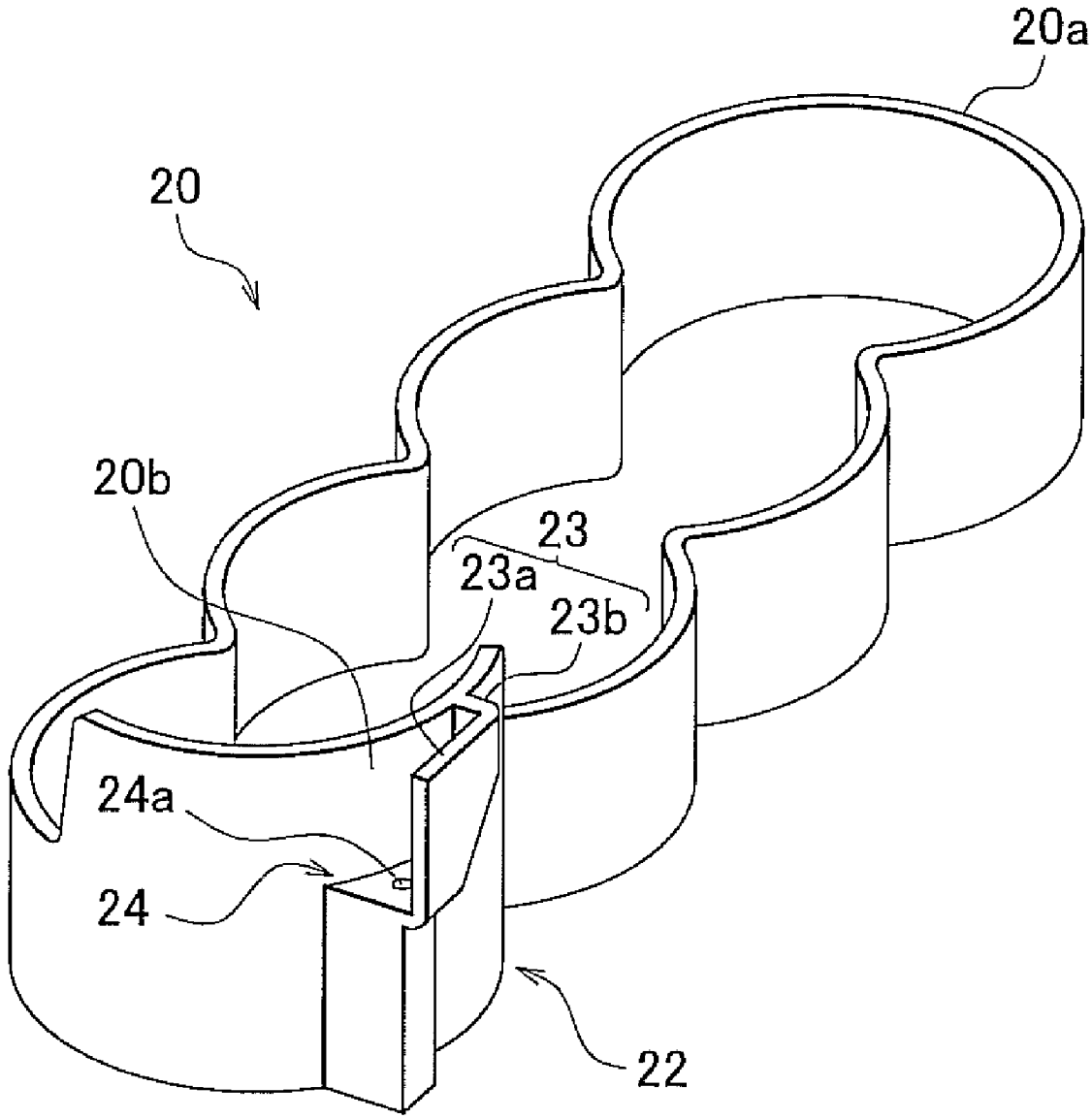
FIG. 3 is a perspective view illustrating the spacer shown in FIG. 1.
Figure 4:
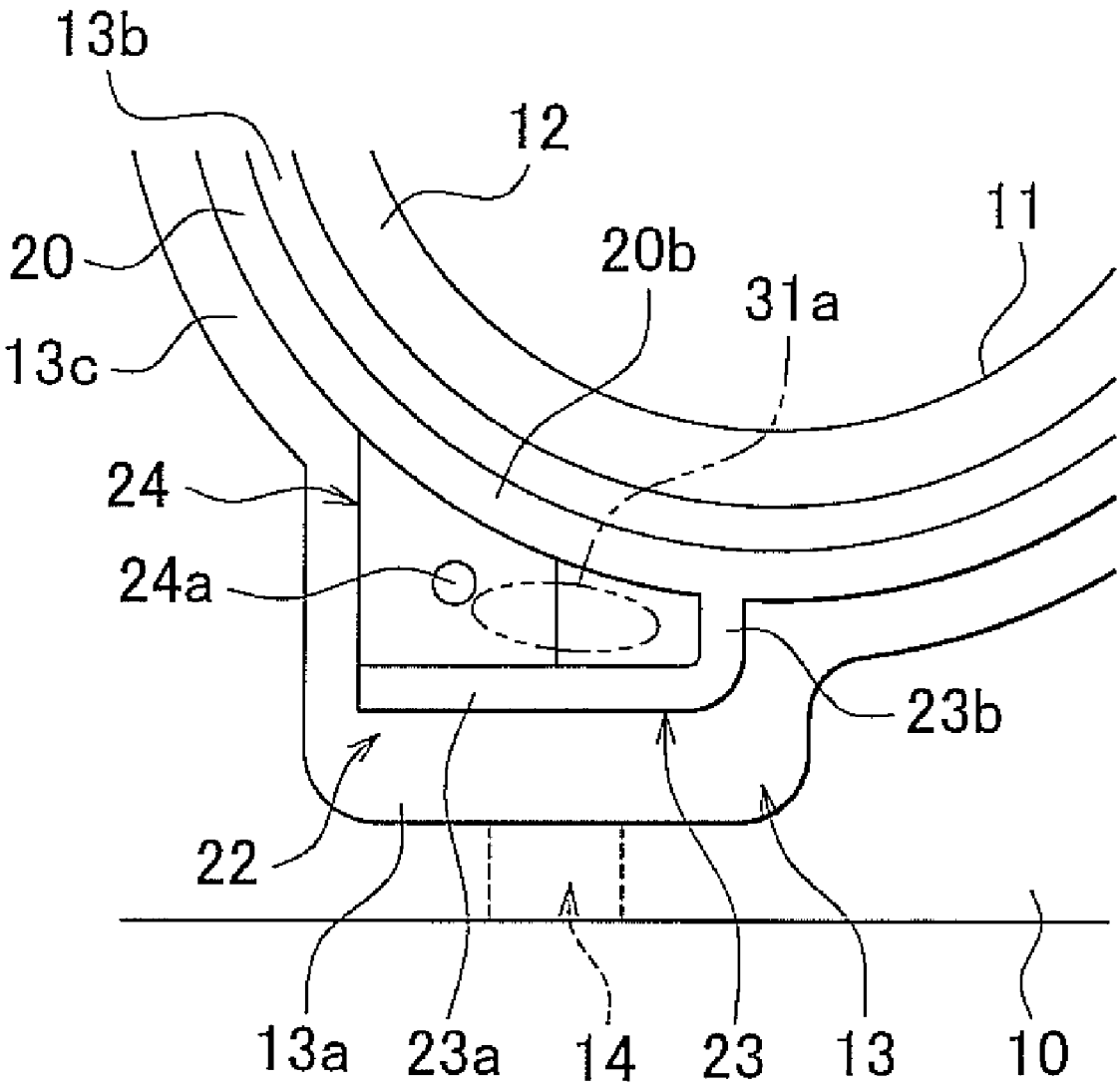
FIG. 4 is a plan view illustrating the regulation member provided at the spacer shown in FIG. 1 and the peripheral portion of the regulation member.
Figure 5:
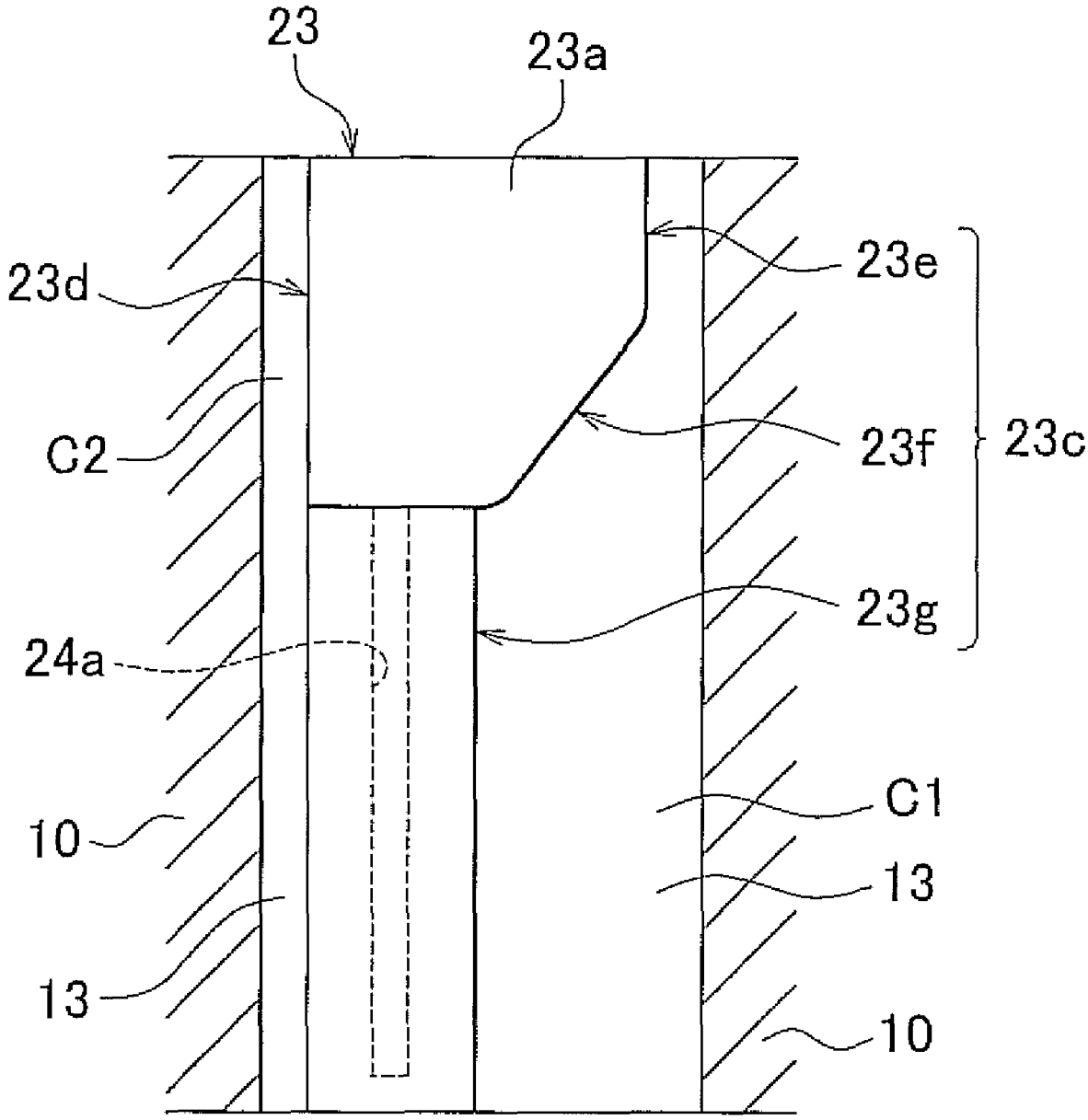
FIG. 5 is a front view illustrating the regulation member provided at the spacer shown in FIG. 1 and the peripheral portion of the regulation member.

The regulation member 22 serving as a regulation portion will be described below in greater detail with reference to FIGS. 1 to 5. FIG. 3 is a perspective view illustrating a spacer 20. FIG. 4 is a plan view illustrating the regulation member 22 and the peripheral portion thereof. FIG. 5 is a front view illustrating the regulation member 22 and the peripheral portion thereof (a view from the direction almost parallel to the flow of cooling water introduced from the cooling water introducing port 14).

As described hereinabove, in the first embodiment, the regulation member 22 is provided integrally with the spacer body 20*a* of the spacer 20. The regulation member 22 is a portion formed to protrude to the outside from the outer circumferential surface of the spacer body 20*a*. In this configuration, the regulation member 22 protrudes toward the cooling water introducing port 14. The regulation member 22 is installed at the cooling water introducing portion 13*a* of the water jacket 13.

The regulation member 22 is formed in a shape that may regulate the flow of cooling water to the gasket hole 31*a* (shown by a double-dashed line in FIG. 4) that is the closest to the cooling water introducing port 14. More specifically, the regulation member 22 is provided with a regulation wall portion 23 for damming up the flow of cooling water to the cylinder head side. Furthermore, a foreign matter collection portion 24 is provided integrally with the regulation wall portion 23.

As shown in FIGS. 4 and 5, the regulation wall portion 23 is provided with a connection portion 23*b* extending from the outer circumferential surface of the spacer body 20*a* in an almost perpendicular direction (normal direction) and a dam portion 23*a* that is bent from the distal end of the connection portion 23*b* and extends in a direction almost perpendicular thereto.

The dam portion 23*a* is a portion that extends in a direction almost perpendicular to the flow direction of the cooling water introduced from the cooling water introducing port 14 and serves as a portion that dams up the cooling water introduced from the cooling water introducing port 14 and disperses (divides) the flow to the left and right sides. The dam portion 23*a* is positioned forward in the flow direction of the cooling water introduced from the cooling water introducing port 14 and is provided upstream in the flow direction of the gasket hole 31*a* that is the closest to the cooling water introducing port 14. In other words, the dam portion 23*a* is provided between the cooling water introducing port 14 and gasket hole 31*a*. This dam portion 23*a* dams up the cooling water upstream of the gasket hole 31*a* and prevents the cooling water from directly flowing into the gasket hole 31*a*.

In a view from the direction perpendicular to the top surface of the water jacket 13, as shown in FIG. 4, in the vicinity of the top surface of the water jacket 13, almost the entire circumference of the gasket hole 31*a* that is the closest to the cooling water introducing port 14 is surrounded by the regulation wall portion 23, outer wall of the cylinder block 10, and portion 20*b* of the spacer body 20*a* located in the vicinity of the cooling water introducing port 14. In other words, in the vicinity of the top surface of the water jacket 13, the gasket hole 31*a* is contained within a portion bounded by the regulation wall portion 23, outer wall of the cylinder block 10, and portion 20*b* of the spacer body 20*a* located in the vicinity of the cooling water introducing port 14. The upper surface of the regulation wall portion 23 is brought into contact with a solid portion of the lower surface of the cylinder head via the cylinder head gasket 30.

The dam portion 23*a* of the regulation wall portion 23 is provided from the bottom portion to the top portion of the water jacket 13. The exhaust-side end portion 23*c* of the dam portion 23*a* on the side of the portion X1 of the water jacket 13 on the exhaust side is opposite the outer wall of the cylinder block 10, as shown in FIG. 5, and a gap C1 is provided between this exhaust-side end portion and the outer wall of the cylinder block 10. The gap C1 serves as an inflow port (supply port) that supplies the cooling water to the portion X1 of the water jacket 13 on the exhaust side, and the supply of the cooling water to the portion X1 on the exhaust side is carried out only from this gap C1. An upper portion 23*e* and a lower portion 23*g* of the exhaust-side end portion 23*c* extend almost parallel to the outer wall of the cylinder block 10. The gap C1 between the exhaust-side end portion and the outer wall of the cylinder block 10 is narrow in the upper portion 23*e* and becomes wider in the lower portion 23*g*. Furthermore, the intermediate portion 23*f* of the exhaust-side end portion 23*c* is sloped, and the gap C1 between the exhaust-side end portion and the outer wall of the cylinder block 10 gradually becomes narrower in the upward direction.

Furthermore, an intake-side end portion 23*d* of the dam portion 23*a* on the side of the portion X2 of the water jacket 13 on the intake side is opposite the outer wall of the cylinder block 10 and extends almost parallel to the outer wall of the cylinder block 10, as shown in FIG. 5. A gap C2 between the intake-side end portion 23*d* and the outer wall of the cylinder block 10 has an almost constant width from the bottom surface to the top surface of the water jacket 13. In this case, the gap C2 is narrower than the narrowest portion of the above-described gap C1 between the exhaust-side end portion 23*c* and the outer wall of the cylinder block 10. The gap C2 serves as an inflow port (supply port) that supplies the cooling water to the portion X2 of the water jacket 13 on the intake side and the water jacket on the cylinder head side, and the supply of the cooling water to the portion X2 on the intake side and to the water jacket on the cylinder head side is carried out only from this gap C2.

A connection portion 23*b* of the regulation wall portion 23 serves as a portion that connects the dam portion 23*a* to the spacer body 20*a*. This connection portion 23*b* is provided from the top surface to the bottom surface of the water jacket 13. Furthermore, the through flow of cooling water between the portion X1 of the water jacket 13 on the exhaust side and the portion X2 on the intake side is blocked by this connection portion 23*b*.

The foreign matter collection portion 24 is provided for collecting foreign matter admixed to the cooling water. In the first embodiment, part of the regulation member 22 provided in a state of protruding from the spacer body 20*a* to the outside (toward the cooling water introducing port 14) is used as the foreign matter collection portion 24. More specifically, the foreign matter collection portion 24 is provided in a portion sandwiched by the spacer body 20*a* and the regulation wall portion 23. Furthermore, the foreign matter collection portion 24 is provided below the gasket hole 31*a* that is the closest to the cooling water introducing port 14. The foreign matter collection portion 24 is opened upward, and has formed therein a blind foreign matter collection orifice 24*a* that extends in an almost vertical direction.

In the first embodiment, the flow of cooling water supplied to the water jacket of the cylinder head via the gasket hole 31*a* is regulated by the regulation member 22 provided in a state of protruding to the outside (toward the cooling water introducing port 14) of the spacer body 20*a*. Therefore, the flow rate of the cooling water supplied to the portion X1 of the water jacket 13 on the exhaust side may be effectively increased with a simple configuration. This feature will be explained below with reference to FIG. 6.

Figure 6:
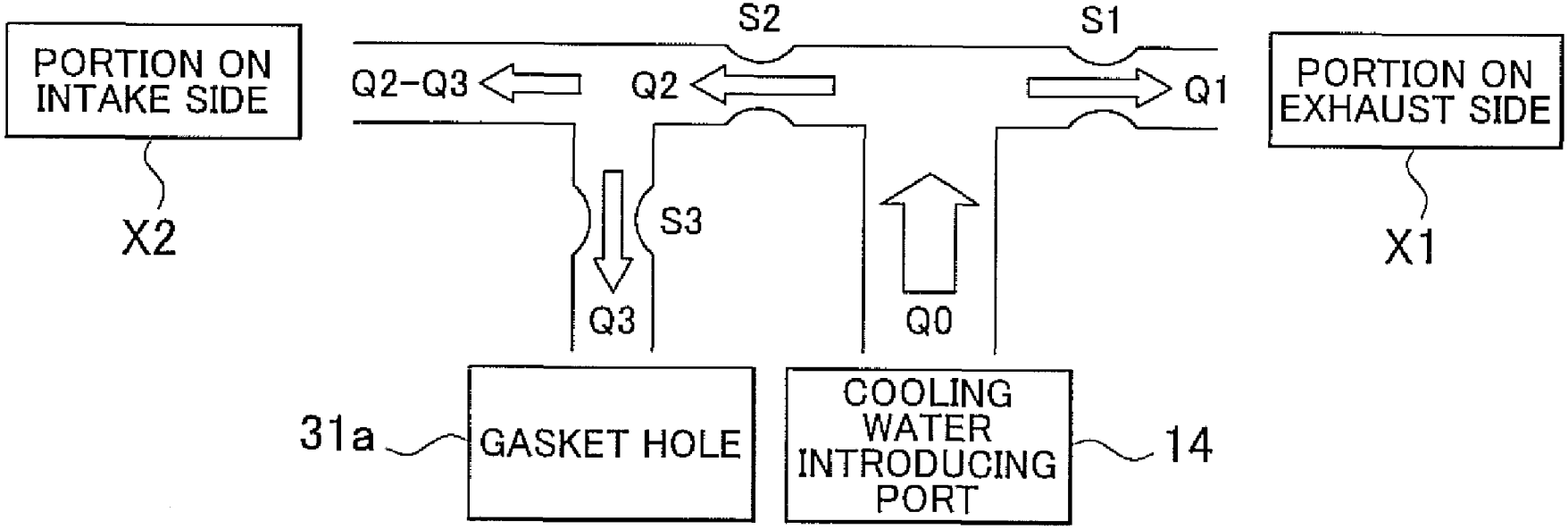
FIG. 6 illustrates schematically the distribution of cooling water introduced from the cooling water introducing port to various parts of the internal combustion engine in the first embodiment of the invention.

FIG. 6 shows schematically the distribution of cooling water introduced from the cooling water introducing port 14 to various parts of the engine in the first embodiment. As shown in FIG. 6, the cooling water that has flown from the cooling water introducing port 14 to the cooling water introducing portion 13*a* of the water jacket 13 (the flow rate of this cooling water is taken as Q0) is dammed up by the dam portion 23*a* of the regulation wall portion 23 of the regulation member 22 positioned forward (front surface) in the flow direction of the cooling water and the cooling water is dispersed to the left and right sides. In other words, the regulation member 22 branches the cooling water into cooling water flowing to one side (right side in FIGS. 4 and 5) and flowing into the portion X1 of the water jacket 13 on the exhaust side and cooling water flowing to the other side (left side in FIGS. 4 and 5) and flowing to a portion other than the portion X1 on the exhaust side.

More specifically, the cooling water that is divided to one side is supplied to the portion X1 of the water jacket 13 on the exhaust side through the gap C1 between the exhaust-side end portion 23*c* of the regulation wall portion 23 and the outer wall of the cylinder block 10 (the flow rate of this cooling water is taken as Q1). In this case, in the portion X1 on the exhaust side, the gap between the spacer body 20*a* and the outer wall of the cylinder block 10, that is, the outer passage 13*c*, is narrower than the gap C1, and the flow channel surface area S1 of the outer passage 13*c* is less than the flow channel surface area of the gap C1. As a result, the cooling water flow rate Q1 to the portion X1 on the exhaust side is determined by the flow channel surface area S1 of the outer passage 13*c*. Furthermore, the cooling water flow rate Q1 to the portion X1 on the exhaust side is set to a flow rate [Q0−Q2] obtained by subtracting the cooling water flow rate Q2 to a portion other than the portion X1 on the exhaust side from the cooling water flow rate Q0 from the cooling water introducing port 14.

Furthermore, the cooling water that is divided to the other side is supplied to the portion X2 of the water jacket 13 on the intake side and to the water jacket on the cylinder head side via the gasket hole 31*a* through the gap C2 between the intake-side end portion 23*d* of the regulation wall portion 23 and the outer wall of the cylinder block 10. In this case, the cooling water flow rate Q2 to a portion other than the portion X1 on the exhaust side is determined by a flow channel surface area S2 of the gap C2.

The cooling water that passed through the gap C2 branches to cooling water that is supplied to the water jacket on the cylinder head side via the gasket head 31*a* and cooling water that is supplied to the portion X2 on the intake side. The flow rate Q3 of the cooling water to the water jacket on the cylinder head side is determined by an opening surface area S3 of the gasket head 31*a*. The flow rate of cooling water to the portion X2 on the intake side is set to a flow rate [Q2−Q3] obtained by subtracting the cooling water flow rate Q3 to the water jacket on the cylinder head side from the cooling water flow rate Q2 to a portion other than the portion X1 on the exhaust side.

Figure 9:
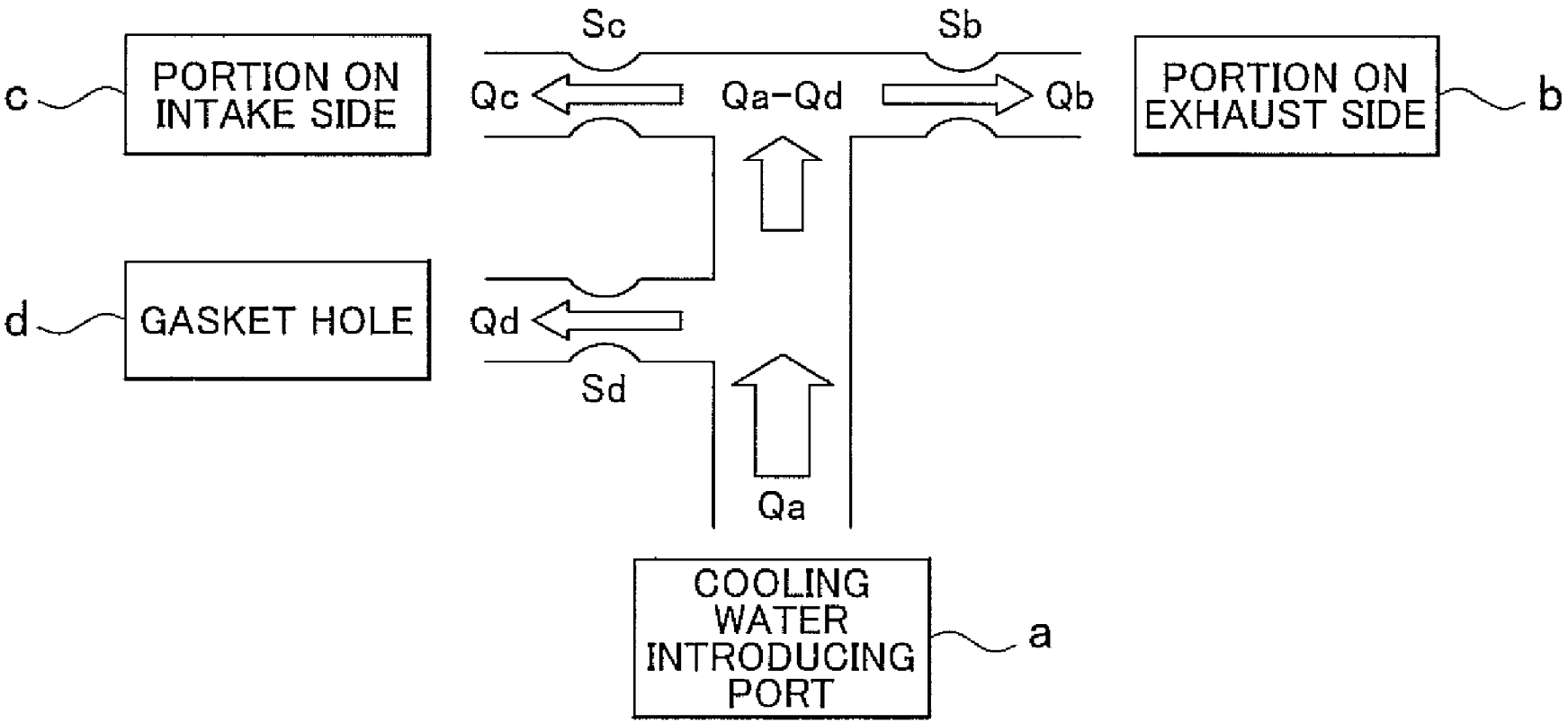
FIG. 9 RELATED ART
FIG. 9 illustrates schematically the distribution of cooling water introduced from the cooling water introducing port to various parts of the internal combustion engine in the related art.

Thus, in the first embodiment, the cooling water to the portion X1 on the exhaust side by the regulation member 22 branches in a site located upstream of the side in which the cooling water to the water jacket on the cylinder head side branches. The flow of cooling water to a portion other than the portion X1 on the exhaust side is regulated by the regulation member 22 in this upstream side and the flow of cooling water is inhibited. As a result, it is possible to ensure the flow rate Q1 of cooling water to the portion X1 on the exhaust side that is larger than the flow rate in the related art (see FIG. 9). In this case, the desired cooling water flow rate Q3 to the water jacket on the cylinder head side has to be ensured by adjusting in advance the opening surface area S3 of the gasket head 31*a*, but a large cooling water flow rate Q1 to the portion X1 on the exhaust side may be ensured, regardless of the value of this cooling water flow rate Q3, by reducing the cooling water flow rate Q2 to a portion other the portion X1 on the exhaust side. Therefore, the cooling water flow rate Q1 to the portion X1 on the exhaust side may be increased, while maintaining the cooling water flow rate Q3 necessary for the water jacket on the cylinder head side.

In this case the cooling water from the cooling water introducing port 14 is distributed to the cooling water flow rate Q1 to the portion X1 on the exhaust side and the cooling water flow rate Q2 to a portion other than the portion X1 on the exhaust side correspondingly to a surface area ratio of the flow channel surface area S1 of the outer passage 13*c* and the flow channel surface area S2 of the gap C2. Therefore, practically the entire cooling water flow rate Q0 from the cooling water introducing port 14 may be caused to contribute to the distribution of the cooling water flow rate Q1 to the portion X1 on the exhaust side. Therefore, the cooling water flow rate Q1 to the portion X1 on the exhaust side may be increased. As a result, a state in which the cooling water flow rate Q1 to the portion X1 of the water jacket 13 on the exhaust side is insufficient may be avoided and the cooling capability of the portion of the cylinder bore wall 12 on the exhaust side (in particular, the upper portion in the vicinity of combustion chambers) may be increased.

Furthermore, because the cooling water flow rate Q2 to a portion other than the portion X1 of the water jacket 13 on the exhaust side is set entirely by the regulation member 22 in one location, the flow rate distribution to the cooling water flow rate Q1 to the portion X1 on the exhaust side and the cooling water flow rate Q2 to other portions may be easily performed with a simple configuration. More specifically, the flow rate distribution of the cooling water flow rate Q1 to the portion X1 on the exhaust side and the cooling water flow rate Q2 to other portions may be performed by adjusting the gap C2 between the intake-side end portion 23*d* of the regulation wall portion 23 of the regulation member 22 and the outer wall of the cylinder block 10.

Further, because the intermediate portion 23*f* of the exhaust-side end portion 23*c* of the dam portion 23*a* is sloped as described hereinabove, the cooling water may easily move from below to above the water jacket 13 by flowing along the slope. As a result, the flow rate loss in transition from below to above the water jacket 13 may be inhibited and cooling capability of the upper portion of the portion of the cylinder bore wall 12 on the exhaust side may be increased. The above-described shape of the exhaust-side end portion 23*c* of the dam portion 23*a* is not limiting, provided that the shape does not impede the flow of cooling water. In this case, it is preferred that a site be provided at the exhaust-side end portion 23*c* such that the gap C1 between this portion and the outer wall of the cylinder block 10 increase gradually from the top downwards.

Furthermore, when the cooling water that has flowed in from the gap C2 flows in the vicinity of the foreign matter collection orifice 24*a*, the foreign matter admixed to the cooling water is introduced into the foreign matter collection orifice 24*a* by the cooling water flow and also falls down into the foreign matter collection orifice 24*a* under gravity. The inside of the foreign matter collection orifice 24*a* has a structure such that makes it difficult for the cooling water to flow therein and for the collected foreign matter to be diffused. As a result, the foreign matter settles on the bottom of the foreign matter collection orifice 24*a*, and the foreign matter contained in the cooling water may thus be removed. Moreover, because the foreign matter collection orifice 24*a* is provided in the vicinity of the gap C2 where the flow rate of cooling water is comparatively high and also provided in a portion sandwiched by the spacer body 20*a* and regulation wall portion 23 where the flow of cooling water is comparatively slow, the foreign matter contained in the cooling water may be efficiently removed.

The first embodiment according to the invention has been thus described. Various modification may be made to this first embodiment.

The configuration of the regulation member is not limited to that of the first embodiment, and any configuration may be used provided that the flow of cooling water supplied to the water jacket of cylinder head may be regulated in the vicinity of the cooling water introducing port of the cylinder block. Examples of configurations for regulating the flow of cooling water include a configuration that dams up the cooling water and a configuration that throttles the flow channel of cooling water.

Figure 7:
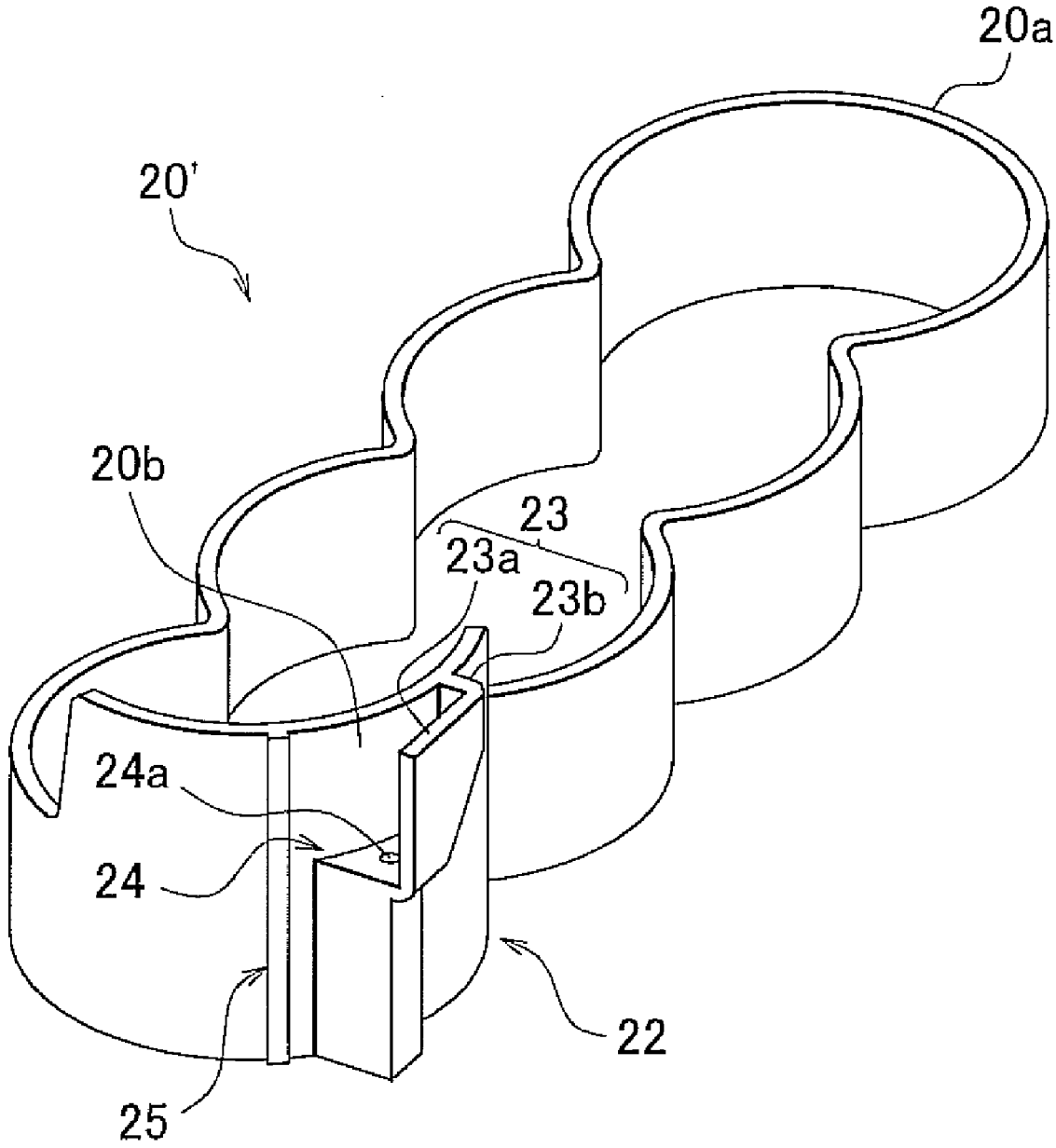
FIG. 7 is a perspective view of the spacer of the second embodiment of the invention.

A configuration for setting the cooling water flow rate to the portion of the water jacket of the cylinder block on the intake side may be added to the configuration of the first embodiment. For example, in the configuration of the second embodiment, a configuration that throttles the flow channel to the portion of the water jacket of the cylinder block on the intake side is added to the configuration of the first embodiment. More specifically, as shown in FIG. 7, the flow channel to a portion X2 of a water jacket 13 of a cylinder block 10 on the intake side is throttled by a protrusion (rib) 25 provided on the outer circumferential surface of a spacer body 20*a* of a spacer 20'. The spacer 20' shown in FIG. 7 is configured by adding the aforementioned rib 25 to the spacer 20 shown in FIG. 3. In this case, the rib 25 is provided from the top surface to the bottom surface of the water jacket 13, but the flow channel surface area S4 of the portion where the rib 25 is provided is set by adjusting the protrusion length of the rib 25 from the spacer body 20*a* or the height in the depth direction of the water jacket 13.

Figure 8:
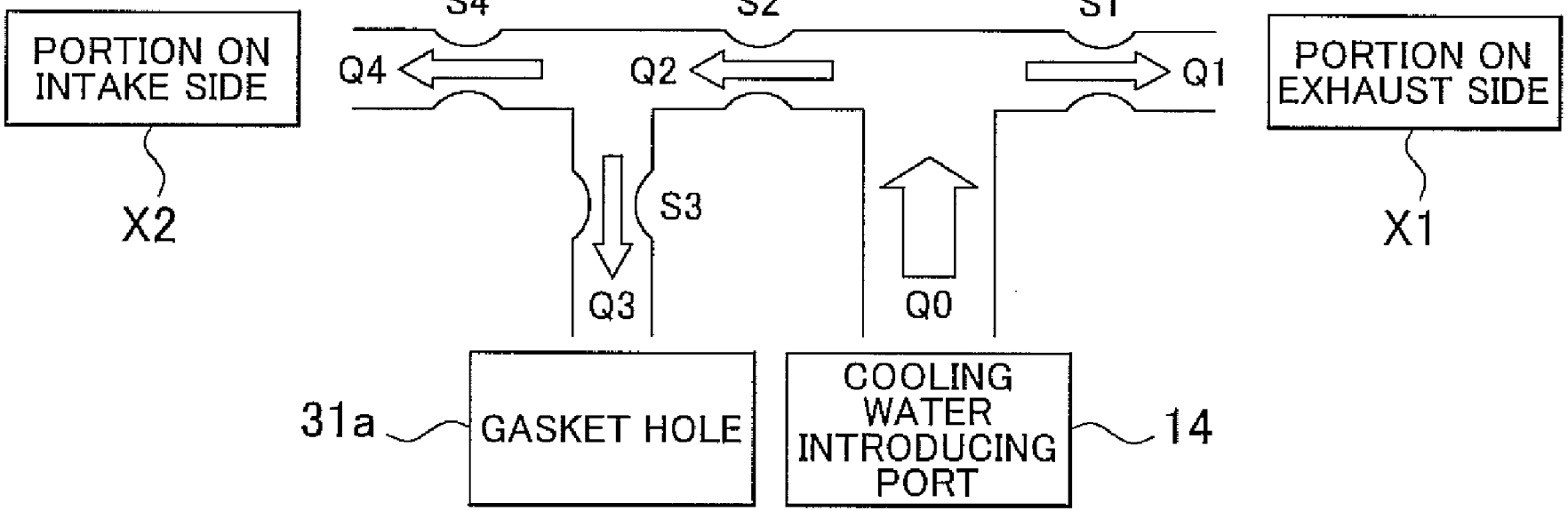
FIG. 8 illustrates schematically the distribution of cooling water introduced from the cooling water introducing port to various parts of the internal combustion engine in the second embodiment of the invention.

Further, in the configuration of the second embodiment, the cooling water introduced from a cooling water introducing port 14 is distributed to various parts, as shown in FIG. 8. The difference between this configuration and the configuration of the first embodiment illustrated by FIG. 6 is that the flow rate Q4 of cooling water supplied to a portion X2 of the water jacket 13 of the cylinder block 10 on the intake side may be adjusted correspondingly to a flow channel surface area S4 throttled by the rib 25. For example, the cooling water flow rate Q4 to the portion X2 on the intake side may be reduced by decreasing the flow channel surface area S4. At the same time, the cooling water flow rate Q1 to the portion X1 on the exhaust side may be effectively increased. In other words, the cooling water flow rate Q1 to the portion X1 on the exhaust side may be increased, while reserving the cooling water flow rate Q4 necessary for the portion X2 on the intake side.

An example in which the regulation member is provided on the cylindrical spacer provided so as to surround the cylinder bore wall of the cylinder block is described above, but it is also possible to provide the regulation member on a spacer of other shape. Furthermore, it is not necessary to provide the regulation member integrally with the spacer, and a configuration may be used in which the regulation member is provided separately from the spacer. Moreover, the regulation member may be provided even in a case where no spacer is used. Essentially, a configuration may be used in which the regulation member that regulates the flow of cooling water supplied to the water jacket of the cylinder head is provided in the vicinity of the cooling water introducing port of the cylinder block, regardless of the presence or shape of the spacer.

While the invention has been described with reference to example embodiments thereof, it should be understood that the invention is not limited to the example embodiments or constructions. To the contrary, the invention is intended to cover various modifications and equivalent arrangements. In addition, while the various elements of the example embodiments are shown in various combinations and configurations, other combinations and configurations, including more, less or only a single element, are also within the spirit and scope of the invention.

What is claimed is:

1. A cooling structure of an internal combustion engine, comprising:

a cooling water introducing port provided on one end side of a cylinder block; and a water jacket provided so as to surround a cylinder bore wall, wherein cooling water is introduced from the cooling water introducing port into the water jacket, the cooling water is branched to flow to a portion on an intake side and a portion on an exhaust side of the water jacket of the cylinder block of the internal combustion engine, and the cooling water is supplied from a cylinder block side to a cylinder head side, the cooling structure of the internal combustion engine, further comprising a first regulation portion that regulates a flow of the cooling water supplied to the cylinder head side, wherein the first regulation portion is provided with a first wall portion that divides the flow of the cooling water from the cooling water introducing port between a flow at a portion on the exhaust side and a flow at a portion other than the portion on the exhaust side, and regulates the flow of the cooling water to the portion other than the portion on the exhaust side, and the portion other than the portion on the exhaust side includes a portion on the intake side and a portion on the cylinder head side.

2. The cooling structure of an internal combustion engine according to claim 1, wherein the first regulation portion regulates, in one location, a flow of the cooling water supplied to a portion other than the portion on the exhaust side.

3. The cooling structure of an internal combustion engine according to claim 1, wherein the first wall portion is provided between the cooling water introducing port and a supply site of the cooling water to the cylinder head side that is the closest to the cooling water introducing port.

4. The cooling structure of an internal combustion engine according to claim 3, wherein a first supply port that supplies the cooling water to the portion on the exhaust side and a second supply port that supplies the cooling water to the portion other than the portion on the exhaust side are formed by the first wall portion and a second wall portion that is a wall portion of the cylinder block.

5. The cooling structure of an internal combustion engine according to claim 4, wherein the second supply port links the portion on the intake side to the supply site.

6. The cooling structure of an internal combustion engine according to claim 4, wherein a second regulation portion that regulates the flow of the cooling water supplied to the portion on the intake side is provided downstream of the second supply port.

7. The cooling structure of an internal combustion engine according to claim 3, wherein the supply site is an opening formed in a cylinder head gasket inserted between the cylinder block and the cylinder head.

8. The cooling structure of an internal combustion engine according to claim 3, wherein a site, in which a gap with a second wall portion that is a wall portion of the cylinder block increases gradually from the cylinder head side in a direction of withdrawing from the cylinder head, is provided at an end portion of the first wall portion on the exhaust side.

9. The cooling structure of an internal combustion engine according to claim 3, wherein the first wall portion includes a first wall surface that is disposed to oppose the flow direction of cooling water introduced from the cooling water introducing port and divides the flow of the cooling water between the flow at the portion on the exhaust side and the flow at the portion other than the portion on the exhaust side; and a second wall surface that prevents the cooling water, which is divided to the portion on the exhaust side by the first wall surface, from flowing to the portion other than the portion on the exhaust side.

10. The cooling structure of an internal combustion engine according to claim 1, wherein the first regulation portion is provided integrally with a spacer that partitions an inside of the water jacket of the cylinder block.

11. The cooling structure of an internal combustion engine according to claim 10, wherein the second regulation portion is provided integrally with a spacer that partitions the inside of the water jacket of the cylinder block.

12. The cooling structure of an internal combustion engine according to claim 1, wherein a foreign matter collection portion configured to collect foreign matter admixed to the cooling water is provided integrally with the first regulation portion.

13. The cooling structure of an internal combustion engine according to claim 12, wherein the foreign matter collection portion is an orifice that is opened on the cylinder head side and extends to withdraw from the cylinder head along a substantially vertical direction.

14. The cooling structure of an internal combustion engine according to claim 12, wherein the foreign matter collection portion is provided in a portion where the flow of the cooling water is regulated by the first regulation portion.

* * * * *